US007160401B2

(12) United States Patent
Hecht et al.

(10) Patent No.: US 7,160,401 B2
(45) Date of Patent: Jan. 9, 2007

(54) USE OF A LOW-ALLOYED COPPER ALLOY AND HOLLOW PROFILE COMPONENT MADE THEREFROM

(75) Inventors: Mainhard Hecht, Hasbergen (DE); Mathias Konczalla, Osnabrueck (DE); Ulrich Naumann, Menden (DE)

(73) Assignee: KM Europa Metal AG, Osnabrück (DE)

( * ) Notice: Subject to any disclaimer, the term of this patent is extended or adjusted under 35 U.S.C. 154(b) by 0 days.

(21) Appl. No.: 10/638,605

(22) Filed: Aug. 11, 2003

(65) Prior Publication Data

US 2004/0120842 A1 Jun. 24, 2004

(30) Foreign Application Priority Data

Aug. 9, 2002 (DE) ..... 102 37 052

(51) Int. Cl.
*C22C 9/02* (2006.01)

(52) U.S. Cl. ..... 148/433; 420/472

(58) Field of Classification Search ..... 148/432–436; 420/470–476

See application file for complete search history.

(56) References Cited

U.S. PATENT DOCUMENTS 5,004,520 A * 4/1991 Tsuji et al. ..... 216/14
5,792,333 A * 8/1998 Oguro et al. ..... 205/103
6,202,703 B1 * 3/2001 Kuroda et al. ..... 138/178

FOREIGN PATENT DOCUMENTS

JP 06-184669 * 5/1994
JP 2002129261 * 5/2002

* cited by examiner

*Primary Examiner*—Sikyin Ip
(74) *Attorney, Agent, or Firm*—Kenyon & Kenyon LLP

(57) ABSTRACT

Use of a low-alloyed, phosphorus-deoxidized copper alloy (DHP-Cu) for manufacturing hollow profile components by internal high-pressure forming, the copper alloy having the following composition: 0.030 to 0.080 wt-% of at least one element of a group including tin (Sn), Zinc (Zn), iron (Fe), silver (Ag) and at least 99.90 wt-% of (Cu) as well as unavoidable impurities as the remainder. Because of its cold work hardening properties, such a copper alloy is especially suitable for the manufacture of hollow profile components by internal high-pressure forming.

4 Claims, No Drawings

USE OF A LOW-ALLOYED COPPER ALLOY AND HOLLOW PROFILE COMPONENT MADE THEREFROM

FIELD OF THE INVENTION

The invention relates to the use of a low-alloyed, phosphorus-deoxidized copper alloy (DHP-Cu) for manufacturing hollow profile components by internal high-pressure forming, as well as a hollow profile component made of the copper alloy.

BACKGROUND INFORMATION

By internal high-pressure forming, processes are understood in which tube-shaped workpieces and hollow profiles are formed with active means support. Using a method of internal high-pressure forming, hollow profile components having improved properties may be manufactured to high precision which, using other methods, could not be implemented, or only implemented at far higher expenditure. For the successful application of the method, besides the selection of suitable components and working materials, knowing the process control limitations is important. For example, too low an internal pressure and, simultaneously, too great a shifting of the tube ends, may lead to unfolding or buckling of the workpiece, whereas strong inside pressure at too little feeding of the tube ends may result in failure by rupturing or bursting.

In addition to seamless and welded tube, alternative tube-shaped semi-finished goods are also successfully formed using this combination of methods, besides various steel materials nonferrous metals also being used. In particular, for manufacturing fittings in piping construction, use is made of oxygen-free copper types deoxidized using phosphorus, having the EN abbreviation Cu-DHP for uses specifying a residual phosphorus content of 0.015 to 0.040%. DHP copper is easily welded and brazed, and is the most important type of copper in machine, equipment and pipe construction.

Although copper is very ductile, that is, easily cold formed, and demonstrates increasing work hardening during cold forming, problems may arise during internal high-pressure forming in the form of wrinkles and cracks. These defects cannot only be attributed to the method parameters.

SUMMARY OF THE INVENTION

It is an object of the invention to demonstrate a low-alloyed, phosphorus-deoxidized copper alloy, for the application of internal high-pressure forming for manufacturing hollow profile components, which in the unformed state has an increased yield strength as well as an increased work hardening tendency, even at a low forming degree. It is a further object to demonstrate hollow profile components made by internal high-pressure forming which have improved material properties.

These and other objects of the invention are achieved by using a low-alloyed, phosphorus-deoxidized copper alloy (Cu-DHP) for manufacturing hollow profile components by internal high-pressure forming, the copper alloy having the following composition: 0.030 to 0.080 weight percent of at least one element of a group including tin (Sn), Zinc Zn), iron (Fe), silver (Ag) 0.015 to 0.040 weight percent phosphorus (P) ≧99.90 weight percent copper (Cu), the remainder unavoidable impurities.

DETAILED DESCRIPTION

According to that, the copper alloy has 0.030 to 0.080 weight percent of at least one element of a group including tin (Sn), zinc (Zn), iron (Fe) and silver (Ag) as well as a phosphorus content of 0.015 to 0.040 weight percent prescribed by standardization and at least 99.90 weight percent of copper, and unavoidable impurities as the remainder.

Experiments have demonstrated that the cold work hardening behavior of DHP-Cu may be raised to the highest possible limit for DHP-Cu, particularly by the addition of tin. It has also been demonstrated that additions of the order of magnitude of impurities, that is, approximately of the order of magnitude of 0.001 weight percent have no relevant influence on the cold work hardening behavior.

The elements tin and zinc may be used, particularly in proportions of 0.030 to 0.050 weight percent, for example tin, having a mass proportion of 0.050 weight percent. Additions of silver on the order of magnitude of 0.008 to 0.010 weight percent also lead to an increase in the yield strength or the 0.2% yield point. The same is true for alloying in silver having a mass proportion of 0.002 to 0.007 weight percent at the same time iron having a mass proportion of 0.005 to 0.010 weight percent.

Within the scope of the present invention, the remainder weight proportions denoted as unavoidable impurities include the total of As, Bi, Cd, Co, Cr, Mn, Ni, O. Pb, S, Sb, Se, Si and Te.

The use of a phosphorus-deoxidated copper alloy having a weight proportion of 99.90% to 99.95% copper is regarded as particularly advantageous when alloyed with tin on the order of magnitude of 0.030 to 0.050 weight percent, especially 0.050 weight percent.

The article part of the object is attained by a profile component which is made of DHP-Cu of the composition described above, particularly at a tin content of 0.030 to 0.050 weight percent.

The hollow profile component may be a piece of tube having at least one branch, especially a T piece.

What is claimed is:

1. A low-alloyed, phosphorus-deoxidized copper alloy consisting of:

0.030 to 0.050 weight percent tin;
0.002 to 0.007 weight percent silver;
0.005 to 0.010 weight percent iron;
0.015 to 0.040 weight percent phosphorus;
≧99.90 weight percent copper; and
unavoidable impurities.

2. The copper alloy according to claim 1, wherein the tin is present in an amount of 0.050 weight percent.

3. A hollow profile component comprising:

an arrangement with a hollow profile, wherein the arrangement comprises a low-alloyed, phosphorus-deoxidized copper alloy, the copper alloy consisting of:
0.030 to 0.050 weight percent tin;
0.002 to 0.007 weight percent silver;
0.005 to 0.010 weight percent iron;
0.015 to 0.040 weight percent phosphorus;
≧99.90 weight percent copper; and
unavoidable impurities.

4. The hollow profile component according to claim 3, wherein the tin is present in an amount of 0.050 weight percent.

* * * * *